US008628130B2

(12) United States Patent
Takeda

(10) Patent No.: US 8,628,130 B2
(45) Date of Patent: Jan. 14, 2014

(54) WORKPIECE TRANSFER APPARATUS FOR PRESS MACHINE AND CROSSBAR UNIT

(75) Inventor: Keisuke Takeda, Kanagawa (JP)

(73) Assignee: Aida Engineering, Ltd., Kanagawa (JP)

( * ) Notice: Subject to any disclaimer, the term of this patent is extended or adjusted under 35 U.S.C. 154(b) by 29 days.

(21) Appl. No.: 13/086,750

(22) Filed: Apr. 14, 2011

(65) Prior Publication Data

US 2011/0254299 A1 Oct. 20, 2011

(30) Foreign Application Priority Data

Apr. 16, 2010 (JP) ..... 2010-095003

(51) Int. Cl.
*B66C 1/02* (2006.01)

(52) U.S. Cl.
USPC ..... 294/65; 294/185

(58) Field of Classification Search
USPC ..... 294/65, 67.33, 81.54, 119.1, 207, 185; 414/627, 737
See application file for complete search history.

(56) References Cited

U.S. PATENT DOCUMENTS

| | | | | |
|---|---|---|---|---|
| 4,732,376 | A * | 3/1988 | Umezawa | 271/267 |
| 4,775,271 | A * | 10/1988 | Maccaferri | 242/473.4 |
| 5,829,811 | A * | 11/1998 | Skinner, II | 294/197 |
| 6,099,059 | A * | 8/2000 | Schultz et al. | 294/119.1 |
| 6,352,402 | B1 * | 3/2002 | Hwang et al. | 414/752.1 |
| 7,029,046 | B2 * | 4/2006 | Lim | 294/65 |
| 7,100,955 | B2 * | 9/2006 | Nakamura | 294/65 |
| 7,118,147 | B2 * | 10/2006 | Fujii | 294/103.1 |
| 7,628,434 | B2 * | 12/2009 | Bruce et al. | 294/65 |
| 7,954,869 | B2 * | 6/2011 | Shim et al. | 294/65 |
| 8,038,191 | B2 * | 10/2011 | Shim et al. | 294/65 |
| 2008/0111388 | A1 * | 5/2008 | Kniss | 294/65 |

FOREIGN PATENT DOCUMENTS

| | | | |
|---|---|---|---|
| EP | 0106056 | A2 | 4/1984 |
| JP | 1 166833 | A | 6/1989 |
| JP | 5-009725 | U | 2/1993 |
| JP | 11-57899 | A | 3/1999 |
| JP | 2003 136164 | A | 5/2003 |
| JP | 2003-136164 | A | 5/2003 |
| JP | 2003-290850 | A | 10/2003 |
| JP | 2003-290851 | A | 10/2003 |
| WO | 02/051574 | A1 | 7/2002 |

OTHER PUBLICATIONS

European Patent Application No. 11161135.6: Extended European Search Report, dated Aug. 3, 2011.

* cited by examiner

*Primary Examiner* — Saul Rodriguez
*Assistant Examiner* — Gabriela Puig
(74) *Attorney, Agent, or Firm* — McDermott Will & Emery LLP

(57) ABSTRACT

Provided is a workpiece transfer apparatus for a press machine including: a workpiece retaining device which is supported by a crossbar extending to be approximately orthogonal to a workpiece transfer direction, and is capable of retaining and releasing a workpiece; a guiding device which supports and guides the workpiece retaining device so that the workpiece retaining device is slidable along a longitudinal direction of the crossbar; a driving device which drives the workpiece retaining device supported and guided by the guiding device so that the workpiece retaining device is moved along the longitudinal direction of the crossbar; and a brake device which acts in a path different from a path of the driving device, the brake device being capable of fixing and releasing a position of the workpiece retaining device with respect to the longitudinal direction of the crossbar.

7 Claims, 5 Drawing Sheets

WORKPIECE TRANSFER APPARATUS FOR PRESS MACHINE AND CROSSBAR UNIT

CROSS REFERENCE TO RELATED APPLICATIONS

The present application claims priority under 35 U.S.C. §119 to Japanese Patent Application No. 2010-095003, filed Apr. 16, 2010, which is incorporated herein by reference.

FIELD OF THE INVENTION

The present invention relates to a workpiece transfer apparatus for a press machine and a crossbar unit, for example, to an apparatus for transferring a workpiece between press machines and a crossbar unit.

BACKGROUND

Various types of apparatuses for transferring a workpiece between press machines have conventionally been proposed.

For example, as a conventional workpiece transfer apparatus including a crossbar unit extending in a direction approximately orthogonal to a workpiece transfer direction, a workpiece transfer apparatus including a crossbar, a workpiece retaining device, a threaded shaft, a rotary driving device, and a guiding device is known. In the conventional workpiece transfer apparatus, the crossbar is reciprocated in the workpiece transfer direction. The workpiece retaining device is provided to the crossbar so as to retain and release the workpiece. The threaded shaft is provided turnably along a longitudinal direction of the crossbar and is threadably engaged with the workpiece retaining device. The rotary driving device rotationally drives the threaded shaft. The guiding device guides and supports the workpiece retaining device by the rotary drive of the threaded shaft so that the workpiece retaining device is movable along the longitudinal direction of the crossbar.

Japanese Patent Application Laid-Open No. 2003-290850 describes the following workpiece transfer apparatus. As illustrated in the accompanying drawings of Japanese Patent Application Laid-Open No. 2003-290850, the workpiece transfer apparatus includes one threaded shaft (20) provided to at least one of crossbars (7) so as to be turnable along a longitudinal direction of the crossbar (7), the threaded shaft including external screws formed at a plurality of positions on an outer circumferential portion thereof, and rotary driving means (25) for rotating the threaded shaft (20). At least each one of a plurality of workpiece retaining means (9) is threadably engaged with each of the plurality of external screws of the threaded shaft (20) so as to be movable along the longitudinal direction of the crossbar (7). A workpiece (11) is transferred for a next process by the retention of the workpiece by the workpiece retaining means (9), the vertical movement of the crossbar (7), and the reciprocation of the crossbar (7) in a workpiece transfer direction.

Japanese Patent Application Laid-Open No. 2003-290851 describes another workpiece transfer apparatus. As illustrated in the accompanying drawings of Japanese Patent Application Laid-Open No. 2003-290851, the workpiece transfer apparatus for a press machine includes a crossbar (7) provided in a direction approximately orthogonal to a workpiece transfer direction, the crossbar being provided with workpiece retaining means (9) capable of retaining a workpiece, a linear motor (17) for allowing the workpiece retaining means (9) provided to at lease one crossbar (7) to be movable along a longitudinal direction of the crossbar (7) and for driving the movement of the workpiece retaining means (9), and a controller (14) for controlling the linear motor (17) in synchronization with an operation of the press machine and/or solely.

Japanese Patent Application Laid-Open No. Hei 11-57899 describes still another workpiece transfer apparatus. As illustrated in the accompanying drawings of Japanese Patent Application Laid-Open No. Hei 11-57899, guide beams (20), which are obtained by detachably connecting guide beam members (19), each being modularized per workpiece transfer pitch unit, in a longitudinal direction, are fixed in parallel on the right and left sides opposed to each other through a press line (L) inside a press housing (4). A guide rail (21) extending along the longitudinal direction is provided on one end surface of each of the guide beam, members (19) of the guide beams (20). A servo motor 24 for lifting, for allowing a crossbar (13) to perform an upward/downward movement operation is assembled to a crossbar carrier (22) movably engaged with and supported by the guide rail (21). A servo motor (27) for feeding, which allows the crossbar (13) to perform a transfer operation through an intermediation of the crossbar carrier (22) by a rack and pinion mechanism is provided.

The workpiece transfer apparatuses, each including the crossbar unit extending in the direction approximately orthogonal to the workpiece transfer direction, as described in Japanese Patent Applications cited above, can automatically change the location of the workpiece retaining means which retains the workpiece by vacuum adsorption or magnetic attraction according to the size or shape of the workpiece to be processed, and hence a preparatory operation can be performed easy, rapid, and precise. In view of the advantage mentioned above, the workpiece transfer apparatuses described above are beneficial.

On the other hand, however, there is a demand to increase a workpiece transfer speed, and eventually to increase a press working speed (to improve production efficiency). The "threaded shaft" and the "rack" extending along the crossbar are relatively heavy in weight as found in the conventional workpiece transfer apparatuses. Therefore, even if the workpiece transfer speed (speed of reciprocation of the crossbar) is to be increased, the workpiece transfer speed cannot be increased above a predetermined level under the actual conditions due to, for example, large vibrations caused by a large inertia force.

For a reduction in weight, for example, it is conceivable to reduce a length of the "threaded shaft" or the "rack". With the reduction in length, however, the range where the workpiece retaining means can move is disadvantageously limited under the actual conditions.

Further, in the conventional configuration using the "threaded shaft" or the "rack", it is necessary to supply oil such as grease between members which are threadably engaged with each other or are meshed with each other. Therefore, there is a fear in that the supplied grease may adhere to the workpiece to adversely affect a subsequent process(es) and quality of products.

SUMMARY OF THE INVENTION

The present invention has been made in view of the above-mentioned actual conditions, and therefore has an object to provide a workpiece transfer apparatus for a press machine and a crossbar unit, which can perform an easy, rapid, and precise preparatory operation and eliminate the need of oil supplying to a driving mechanism by realizing a mechanism capable of automatically changing a position of a workpiece retaining device relative to a longitudinal direction of a crossbar with a simple, inexpensive, lightweight, and compact configuration so as to meet a requirement of improvement of a workpiece transfer speed, and eventually a requirement of improvement of production efficiency.

For this reason, a workpiece transfer apparatus for a press machine according to the present invention includes: a workpiece retaining device which is supported by a crossbar extending to be approximately orthogonal to a workpiece transfer direction, and is capable of retaining and releasing a workpiece; a guiding device which supports and guides the workpiece retaining device so that the workpiece retaining device is slidable along a longitudinal direction of the crossbar; a driving device which drives the workpiece retaining device supported and guided by the guiding device so as to be slidable along the longitudinal direction of the crossbar so that the workpiece retaining device is moved along the longitudinal direction of the crossbar; and a brake device which acts in a path (or route) different from a path of the driving device, the brake device being capable of fixing and releasing a position of the workpiece retaining device supported and guided by the guiding device so as to be slidable along the longitudinal direction of the crossbar, with respect to the longitudinal direction of the crossbar.

In the workpiece transfer apparatus for a press machine according to the present invention, the driving device includes: an electric motor mounted approximately integrally with a workpiece retaining device side; a pinion gear mounted to an output rotary shaft of the electric motor; and a rack gear meshed with the pinion gear and mounted approximately integrally with a crossbar side along the longitudinal direction of the crossbar.

In the workpiece transfer apparatus for a press machine according to the present invention, the brake device is mounted approximately integrally with a workpiece retaining device side and allows a friction element to act on the crossbar so that the position of the workpiece retaining device can be fixed and released with respect to the longitudinal direction of the crossbar.

In the workpiece transfer apparatus for a press machine according to the present invention, the friction element acts on a guide rail of the guiding device, the guide rail extending approximately integrally with the crossbar along the longitudinal direction of the crossbar.

Further, a crossbar unit of a workpiece transfer apparatus for a press machine according to the present invention includes: a crossbar extending to be approximately orthogonal to a workpiece transfer direction, for supporting a workpiece retaining device capable of retaining and releasing a workpiece; a guiding device which supports and guides the workpiece retaining device so that the workpiece retaining device is slidable along a longitudinal direction of the crossbar; a driving device which drives the workpiece retaining device supported and guided by the guiding device so as to be slidable along the longitudinal direction of the crossbar so that the workpiece retaining device is moved along the longitudinal direction of the crossbar; and a brake device which acts in a path (or route) different from a path of the driving device, the brake device being capable of fixing and releasing a position of the workpiece retaining device supported and guided by the guiding device so as to be slidable along the longitudinal direction of the crossbar, with respect to the longitudinal direction of the crossbar.

According to present invention, there can be provided the workpiece transfer apparatus for a press machine and the crossbar unit, which can perform the easy, rapid, and precise preparatory operation and eliminate the need of oil supplying to the driving mechanism by realizing the mechanism capable of automatically changing the position of the workpiece retaining device relative to the longitudinal direction of the crossbar with a simple, inexpensive, lightweight, and compact configuration so as to meet the requirement of improvement of the workpiece transfer speed, and eventually the requirement of improvement of production efficiency.

DETAILED DESCRIPTION

Hereinafter, an embodiment illustrative of an example of a workpiece transfer apparatus for a press machine according to the present invention is described referring to the accompanying drawings. Note that, the present invention is not limited by the embodiment described below.

Figure 1:
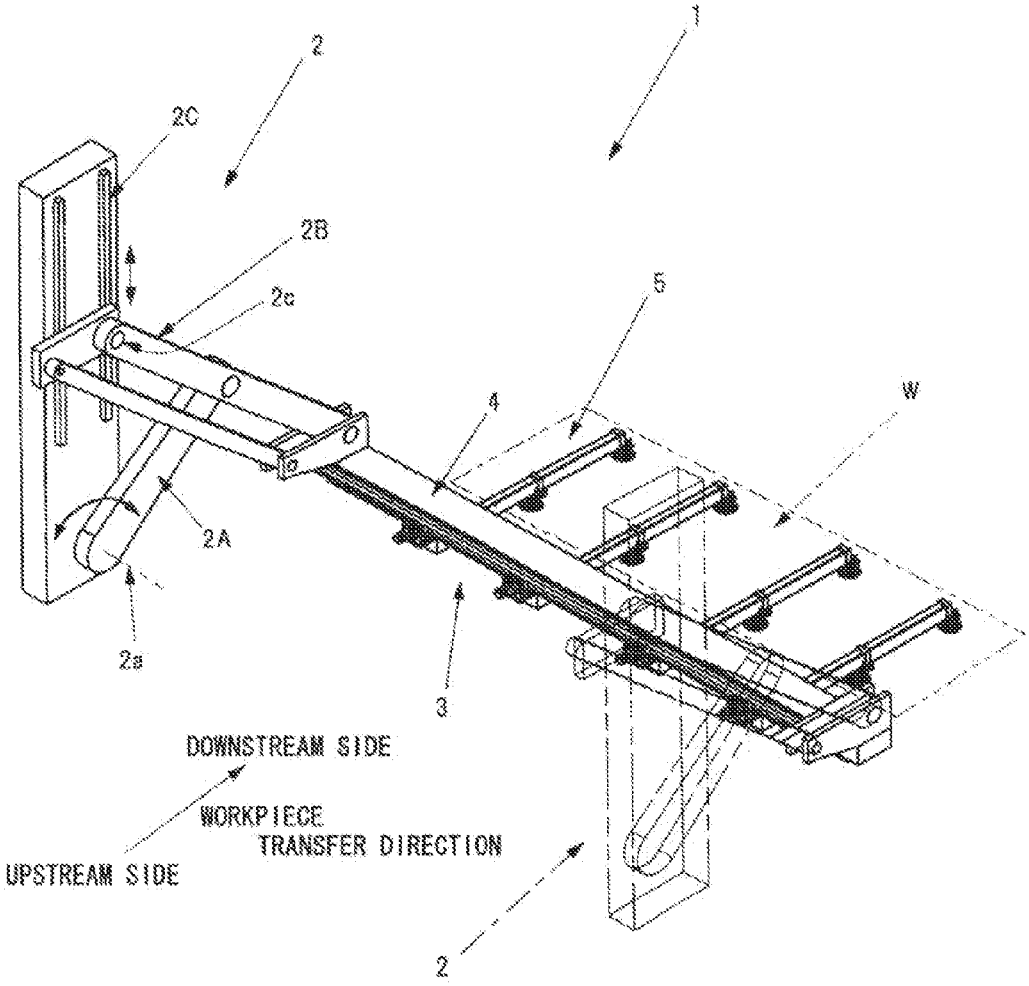
FIG. 1 is a perspective view schematically illustrating an overall configuration of a workpiece transfer apparatus for a press machine, according to an embodiment of the present invention.
Figure 2:
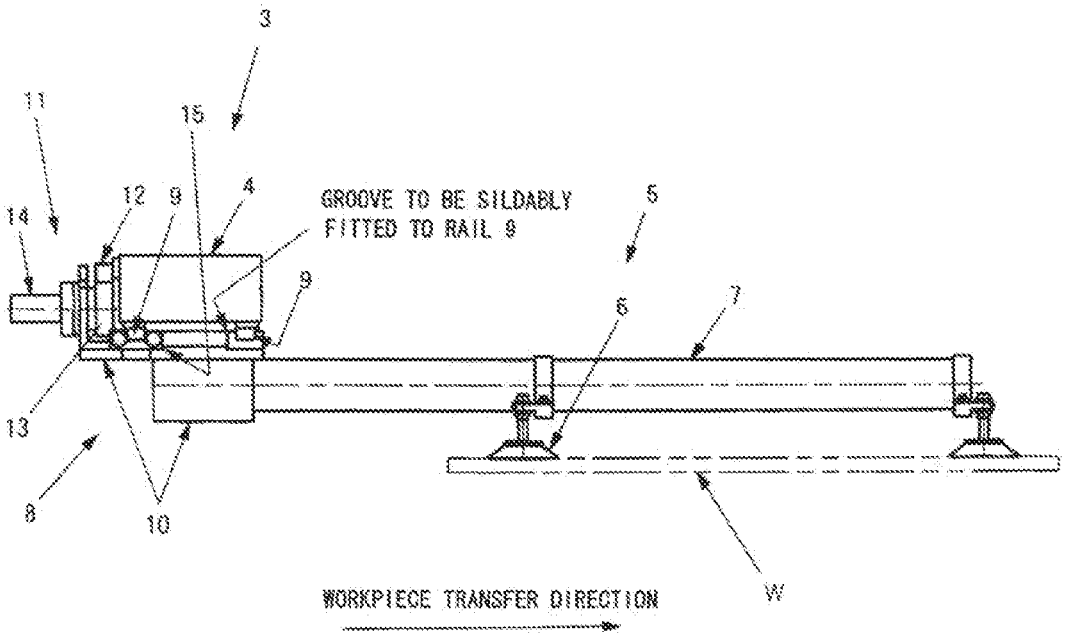
FIG. 2 is a side view of a crossbar unit constituting the workpiece transfer apparatus for the press machine, according to the embodiment of the present invention (as viewed from a direction orthogonal to a workpiece transfer direction)
Figure 3:
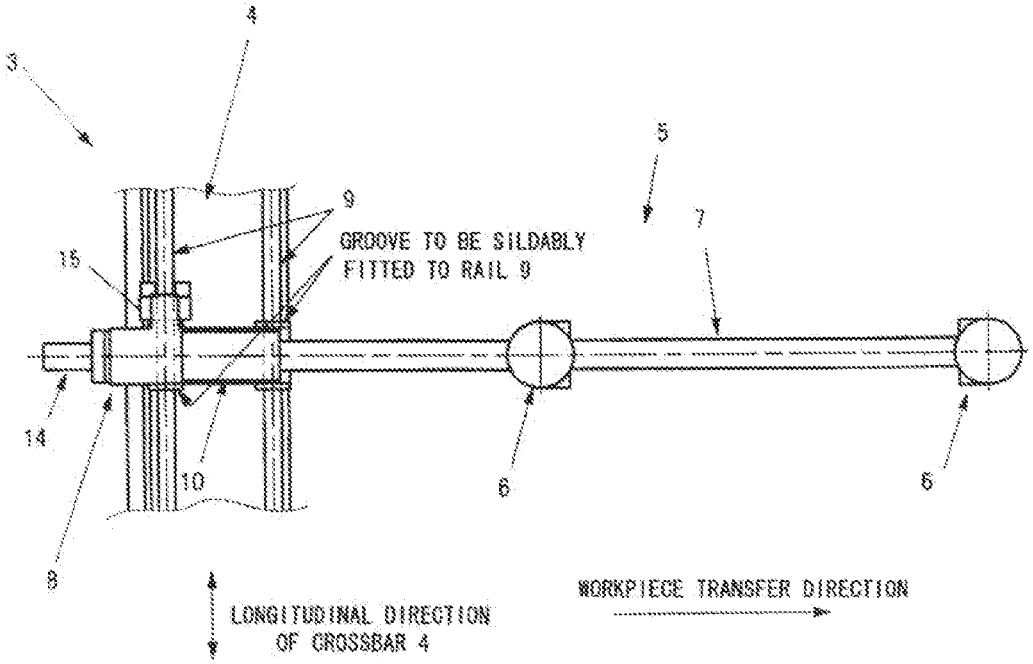
FIG. 3 is a bottom view of the crossbar unit constituting the workpiece transfer apparatus for the press machine illustrated in FIG. 2 as viewed from a bottom side (workpiece W side)
Figure 4A:
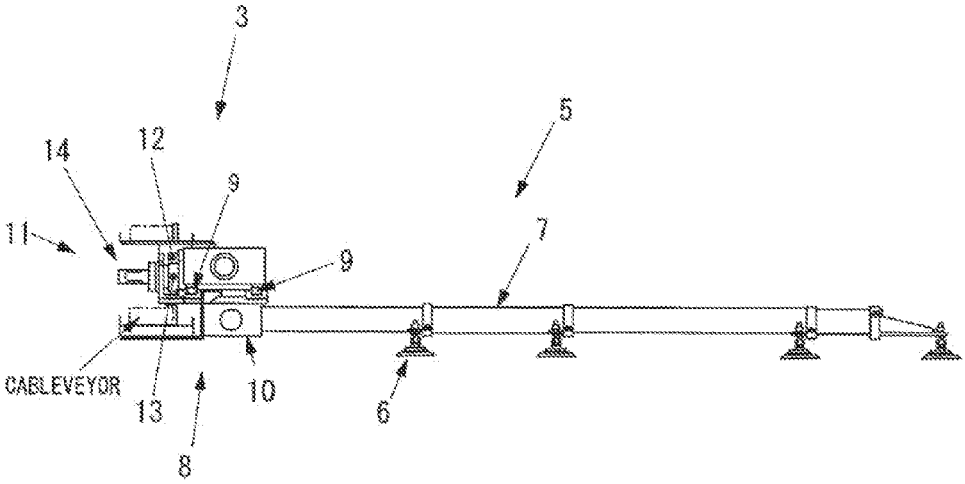
FIG. 4A is a side view illustrating the crossbar unit (another configuration example) constituting the workpiece transfer apparatus for the press machine, according to the embodiment of the present invention (as viewed from the direction orthogonal to the workpiece transfer direction)
Figure 4B:
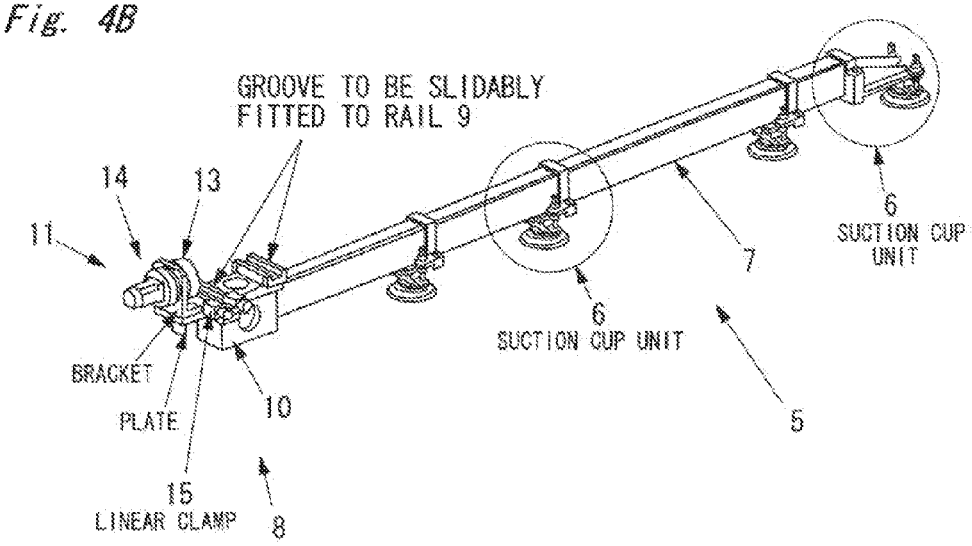
FIG. 4B is a perspective view of FIG. 4A from which a crossbar and rails are omitted.

As illustrated in FIG. 1, a workpiece transfer apparatus 1 for a press machine according to the embodiment is configured as follows. A workpiece W is retained by workpiece retaining devices 5 (corresponding to a workpiece retaining device according to the present invention) supported by a crossbar 4, using vacuum adsorption or the like. Then, a rocking arm 2A of each of driving devices 2 for workpiece transfer is rocked (turned) about a turning support point 2*a* toward downstream in a transfer direction while the retention state of the workpiece W is maintained. As a result, a link arm 2B connected to the rocking arm 2A is rocked about a turning support point 2*c*, which vertically moves along guide grooves 2C, as a center of rocking. In this manner, the crossbar 4 connected to a distal end of the link arm 2B and the workpiece retaining devices 5 can be moved to eventually transfer the workpiece W toward downstream in the transfer direction.

When the workpiece W is transferred to a predetermined position located downstream in the transfer direction by the rocking of the rocking arm 2A and the link arm 2B as described above, the vacuum adsorption using the workpiece retaining devices 5 is released to release the workpiece W. Then, for the retention of a next workpiece W, each of the driving devices 2 for workpiece transfer rocks the rocking arm 2A in the opposite direction (toward upstream in the transfer direction) to rock the link arms 2B about the turning support point 2*c* toward upstream in the transfer direction. In this manner, the crossbar 4 connected to the distal end of the link arm 2B and the workpiece retaining devices 5 are returned to initial positions (positions where the retention of the next workpiece W is to be started).

In the above-mentioned manner, the workpiece transfer apparatus 1 according to the embodiment transfers the workpiece W. A position in a longitudinal direction of the crossbar 4, where each of the workpiece retaining devices 5 is provided, is required to be automatically changed according to a shape and size of the workpiece W in view of facility, rapidity, and precision of a preparatory operation.

Conventionally, however, when an automatic driving mechanism for satisfying the above-mentioned request is provided on the crossbar, a crossbar unit 3 (in particular, a driving mechanism for moving the workpiece retaining devices 5 along the longitudinal direction of the crossbar 4) is disadvantageously increased in weight. As a result, vibrations or the like become larger with an increase in workpiece transfer speed. Therefore, it is difficult to increase the workpiece transfer speed above a predetermined level. In view of the problem described above, the inventor of the present invention has conducted various examinations, studies, and experiments. As a result, the following workpiece transfer apparatus is obtained.

As illustrated in FIG. 1, in the workpiece transfer apparatus 1 according to the embodiment, the driving devices 2 for workpiece transfer are provided on both sides in the transfer direction. The crossbar unit 3 is provided between the driving devices 2 for workpiece transfer.

As illustrated in FIGS. 1 to 4B, the crossbar unit 3 includes the crossbar 4, the workpiece retaining devices 5, guiding devices 8, driving devices 11, and brake devices 15. The crossbar 4 is provided to extend between the driving devices 2 for workpiece transfer provided on both sides. The workpiece retaining devices 5 are supported by the crossbar 4 so as to be capable of retaining and releasing the workpiece W by, for example, vacuum adsorption. The guiding device 8 (corresponding to a guiding device according to the present invention) guides the movement of the workpiece retaining device 5 along the longitudinal direction of the crossbar 4. The driving device 11 (corresponding to a driving device according to the present invention) drives the movement of the workpiece retaining device 5 along the longitudinal direction of the crossbar 4 (guiding device 8). The brake device 15 (corresponding to a brake device according to the present invention) fixes and releases the position of the workpiece retaining device 5 in the longitudinal direction of the crossbar 4 (guiding device 8).

The workpiece retaining device 5 can retain and release the workpiece W by, for example, vacuum adsorption or magnetic attraction. In this embodiment, the workpiece retaining device 5 includes suction cup units 6 and a bracket 7 as an example, as illustrated in FIGS. 2 to 4B. The suction cup units 6 can retain and release the workpiece W by vacuum adsorption. The bracket 7 supports the suction cup units 6 and extends along the direction of transfer of the workpiece W.

The guiding device 8 includes rails 9 and a block 10. The rails 9 extend along the longitudinal direction of the crossbar 4. The block 10 is engaged with the rails 9 so as to be slidable in the longitudinal direction of the crossbar 4 (rails 9) and supports the bracket 7 of the workpiece retaining device 5.

In this embodiment, the plurality of workpiece retaining devices 5 (brackets 7) are provided in parallel to each other in the workpiece transfer direction as illustrated in FIG. 1. An end of each of the brackets 7 is supported by a corresponding one of the blocks 10 of the guiding devices 8.

Therefore, each of the brackets 7 is movable with the movement of the corresponding guiding device 8 along the longitudinal direction of the crossbar 4 (rails 9).

The driving device 11 is mounted approximately integrally with each corresponding block 10. The driving device 11 includes a rack gear 12 and an electric motor 14. The rack gear 12 is mounted approximately integrally with the crossbar 4 along the longitudinal direction of the crossbar 4. The electric motor 14 includes a pinion gear 13 to be meshed with the rack gear 12. The pinion gear 13 is provided to an output rotary shaft of the electric motor 14. As the electric motor 14, for example, a lightweight servo motor can be used.

The rack gear 12 and the pinion gear 13 according to the embodiment are made of nylon (registered trademark).

For example, monomer cast nylon (MC nylon (registered trademark: Nippon Polypenco Limited)) has a desired strength and is highly self-lubricating, and therefore is advantageous in that oil supplying such as grease or the like is not required. The monomer cast nylon is obtained by polymerizing and molding a nylon monomer corresponding to a main material under an atmospheric pressure.

As illustrated in FIGS. 2 to 4B, the brake device 15 is mounted approximately integrally with each corresponding block 10. The brake device 15 is configured to be able to fix and release the corresponding block 10 and the corresponding workpiece retaining device 5 at a predetermined position with respect to the longitudinal direction of the rails 9 by retaining and releasing at least one of the rails 9 of the guiding device 8.

As the brake device 15, for example, a linear clamp (product name "Linear Clamper-Zee" (registered trademark)) fabricated by Nabeya Bi-tech Kaisha (NBK) can be used.

The linear clamp 15 is configured to directly clamp one of the linear guide rails (rails 9) so as to retain and position a linear clamp body, and eventually the corresponding block 10, with respect to the one of the linear guide rails (rails 9).

Figure 5:
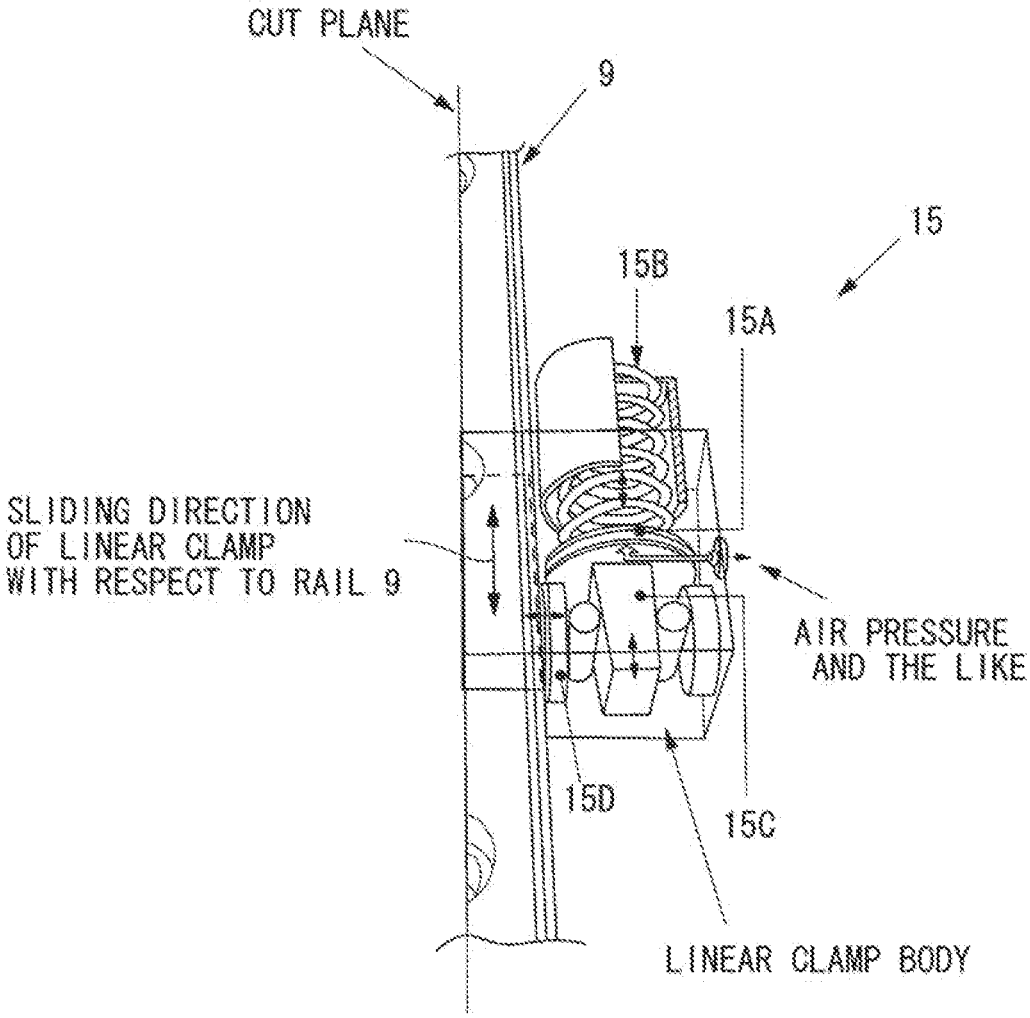
FIG. 5 is a partial perspective view for illustrating an example of a brake device constituting the workpiece transfer apparatus for the press machine, according to the embodiment of the present invention.

For example, as illustrated in FIG. 5, the linear clamp (corresponding to an example of the brake device) 15 includes a piston 15A, a spring 15B, a wedge element 15C, and a friction element 15D. Inside the linear clamp body which is engaged with the rail 9 so as to be slidable in the longitudinal direction of the rail 9, the piston 15A is provided. The piston 15A is elastically biased downward in FIG. 5 by the spring 15B. On a bottom surface (on the lower side in FIG. 5) of the piston 15A, the wedge element 15C having a thinned end on the lower side in FIG. 5 is mounted.

On the left of the wedge element 15C in FIG. 5, the friction element 15D is provided so as to face the rail 9. The friction element 15D is brought into contact with and separated away from the rail 9 according to vertical movement of the wedge element 15C.

Specifically, in a state in which an air pressure and the like is not exerted on the bottom surface of the piston 15A, the piston 15A is pressed by the spring 15B to be elastically biased downward in FIG. 5. At this time, the wedge element 15C, which is located below the piston 15A, is also moved downward in FIG. 5 in an interlocking manner. Therefore, the friction element 15D is pressed toward the rail 9 to be brought into abutment onto the rail 9 by an enlarged portion corresponding to a base end side (upper side in FIG. 5) of the wedge element 15C. As a result, a friction force is generated between the friction element 15D and the rail 9 to fixedly retain the linear clamp body (brake device 15), and eventually the block 10, to the rail 9.

Although not shown in FIG. 5, the same mechanism can be provided plane-symmetrically on the opposite side of a cut plane illustrated in FIG. 5. As a result, a braking force of the brake device 15 is expected to be increased.

On the other hand, when the air pressure and the like is exerted on the bottom surface of the piston 15A, the piston 15A is moved upward in FIG. 5 against the elastic biasing force of the spring 15B. At this time, the wedge element 15C, which is located below the piston 15A, is also moved upward in FIG. 5 in an interlocking manner. Therefore, the friction element 15D is engaged with a thin portion corresponding to a distal end side (lower side in FIG. 5) of the wedge element 15C. As a result, a pressing force of the friction element 15D to the rail 9 disappears, and hence a friction force disappears between the friction element 15D and the rail 9. Therefore, the linear clamp body (brake device 15), and eventually the block 10 become slidable with respect to the rail 9.

The workpiece transfer apparatus 1 according to the embodiment having the configuration described above can automatically move the bracket 7 of each of the workpiece retaining devices 5 along the longitudinal direction of the crossbar 4 in the preparatory operation or the like so as to correspond to the size or shape of the workpiece W. The above-mentioned operation includes the following steps.

First, in Step 1, the brake device 15 releases the retention of the rail 9. Specifically, for example, the air pressure is applied to disengage the friction element 15D and the rail 9 from each other so that the block 10 becomes slidable with respect to the rail 9.

In Step 2, the electric motor 14 of the driving device 11 is rotationally driven in a desired direction. The block 10 (bracket 7), which is approximately integral with the electric motor 14, is moved to a desired position along the longitudinal direction of the rail 9, and therefore that of the crossbar 4, by the mechanism of the rack gear 12 and the pinion gear 13, according to a predetermined program or by a manual operation.

In Step 3, when the block 10 (bracket 7) is moved to reach the desired position, the driving of the electric motor 14 is stopped. At the same time, the block 10 is retained and fixed with respect to the rail 9 by the brake device 15. More specifically, the air pressure is released to bring the friction element 15D into abutment onto the rail 9 through an elastic biasing force of the spring 15B. In this manner, the block 10 is retained and fixed with respect to the rails 9 by the friction force.

As described above, when the workpiece retaining device 5 (bracket 7, block 10, and the like) is retained and fixed with respect to the rails 9 and therefore to the crossbar 4 by the brake device 15, the retention force for retaining the workpiece retaining device 5 with respect to the rails 9 and therefore to the crossbar 4 can be prevented from being exerted on the rack gear 12 and the pinion gear 13.

Specifically, even in a situation where a relatively large exciting force such as shaking occurring due to an inertia force or vibrations during the transfer of the workpiece is exerted, the block 10 can be reliably retained and fixed to the rails 9 by the brake device 15. Therefore, the relatively large force as described above can be prevented from being exerted on the rack gear 12 and the pinion gear 13.

Thus, for the preparation (for example, in Step 2 described above), only a relatively small torque, which is generated when the brake device 15 is released to move the workpiece retaining device 5 (bracket 7, block 10, and the like) by the electric motor 14 along the longitudinal direction of the crossbar 4, is exerted on the rack gear 12 and the pinion gear 13. Therefore, as a material of the rack gear 12 and the pinion gear 13, a material which has a relatively small strength and a small specific gravity, for example, a resin such as nylon, can be used.

Moreover, in this embodiment, the driving device 11 is configured to include the rack gear 12 and the pinion gear 13. Therefore, each of the workpiece retaining devices 5 can be moved independently of the other workpiece retaining devices 5. Accordingly, each of the workpiece retaining devices 5 can be provided at an arbitrary position. In addition, a range of movement can be set largely. Thus, a degree of adaptation to a change in size or shape of the workpiece W can be increased.

As described above, the workpiece transfer apparatus 1 according to the embodiment uses the driving device 11. The driving device 11 uses the rack gear 12, which is provided along the longitudinal direction of the crossbar 4, and the pinion gear 13, which is meshed with the rack gear 12 and is driven by the electric motor 14. In addition, the workpiece retaining device 5 (bracket 7, block 10, and the like) is retained and released with respect to the crossbar 4 by the brake device 15 which is independent of the driving device 11. Therefore, even in a situation where a relatively large exciting force such as shaking occurring due to the inertia force or vibrations during the transfer of the workpiece is exerted, a load is prevented from being applied to the driving device 11.

Therefore, in the configuration in which the driving device is directly subjected to the exciting force as in the conventional configurations, it has been necessary to increase a capacity and a strength of each component by increasing the size of the driving device 11 so that the workpiece retaining device 5 (bracket 7, block 10, and the like) does not move freely under the exciting force. According to the embodiment, however, it is not necessary to increase the size of the driving device. Therefore, the driving device can be reduced in size as well as in weight. In addition, a fear of partial abrasion of a gear mechanism of the driving device due to the exciting force can be reduced. Accordingly, the use of a lubricant can be omitted.

For the above-mentioned reasons, the electric motor 14 which has a small capacity and is small and lightweight, can be used. In addition, the rack gear 12 provided along the longitudinal direction of the crossbar 4, which is relatively elongated, can be made of a material having a small specific gravity to resin such as monomer cast nylon or a light metal). As a result, the weight of the crossbar unit 3 can be significantly reduced.

Thus, according to the workpiece transfer apparatus 1 of this embodiment, the weight of the crossbar unit 3 (the crossbar 4, the driving devices 11, the workpiece retaining devices 5, and the like) corresponding to a movable portion during the workpiece transfer can be reduced, which can in turn reduce the inertia force of the crossbar unit 3. A workpiece transfer speed can be increased as compared with the case of the conventional workpiece transfer apparatuses, which can in turn improve production efficiency.

According to the workpiece transfer apparatus 1 of this embodiment, the position where each of the workpiece retaining devices 5 is to be provided in the longitudinal direction of the crossbar 4 can be automatically changed according to the shape or size of the workpiece W. Thus, the preparatory operation can be easy, rapid, and precise.

The material of the rack gear 12 and the pinion gear 13 according to the embodiment is not limited to nylon. Other resin materials having a small specific gravity such as engineering plastics can be used. Other materials, for example, small specific-gravity metal materials such as aluminum and titanium can also be used according to various characteristics (according to a degree of demand of increase in transfer speed, a degree of demand of reliability, a degree of demand of reduction in noise and vibrations, a problem of contamination with grease or the like).

The rack gear 12 and the pinion gear 13 do not need to be made of the same material. A combination of different materials can be used for the rack gear 12 and the pinion gear 13.

In this embodiment, although the linear clamp has been described as a representative example of the brake device 15, the brake device 15 is not limited thereto. Any brake device, which is configured to be able to fix and release the workpiece retaining device 5 (bracket 7, block 10, and the like) with respect to/from the crossbar 4 in a path (or route) different from that used by the driving device 11, can be used in the present invention.

The embodiment described above is a mere illustration for the description of the present invention. Therefore, various changes are possible without departing from the scope of the present invention.

What is claimed is:

1. A workpiece transfer apparatus for a press machine, comprising:

a workpiece retaining device configured to retain and release a workpiece, the workpiece retaining device being supported by a crossbar extending in a direction approximately orthogonal to a workpiece transfer direction; and a guiding device configured to support and guide the workpiece retaining device so that the workpiece retaining device is slidable along the extending direction of the crossbar, the guiding device comprising:

a driving device configured to drive the workpiece retaining device to slidably move along the extending direction of the crossbar; and a brake device configured to hold the workpiece retaining device not to move along the extending direction of the crossbar and release the workpiece retaining device to be slidable along the extending direction of the crossbar, wherein the brake device is physically independent of, and not in part of, the driving device.

2. The workpiece transfer apparatus for a press machine according to claim 1, wherein the driving device includes:

an electric motor;

a pinion gear mounted to an output rotary shaft of the electric motor; and a rack gear, extending along the extending direction of the crossbar, meshed with the pinion gear and mounted on a crossbar.

3. The workpiece transfer apparatus for a press machine according to claim 1, wherein the brake device is configured to allow a friction element to act on the crossbar so that the position of the workpiece retaining device is fixed and released with respect to the longitudinal direction of the crossbar.

4. The workpiece transfer apparatus for a press machine according to claim 1, wherein a friction element acts on a guide rail of the guiding device, the guide rail extending along the extending direction of, and being attached to, the crossbar.

5. The workpiece transfer apparatus for a press machine according to claim 1, wherein the brake device comprises a friction element, and is configured to compress the friction element only to one side of the crossbar to hold the workpiece retaining device, without having another friction element to be compressed to another side of the crossbar.

6. A crossbar unit of a workpiece transfer apparatus for a press machine, comprising:

a crossbar extending in a direction approximately orthogonal to a workpiece transfer direction for supporting a workpiece retaining device, the workpiece retaining device being configured to retain and release a workpiece; and a guiding device configured to support and guide the workpiece retaining device so that the workpiece retaining device is slidable along the extending direction of the crossbar, the guiding device comprising:

a driving device configured to drive the workpiece retaining device to slidably move along the extending direction of the crossbar; and a brake device configured to hold the workpiece retaining device not to move along the extending direction of the crossbar and release the workpiece retaining device to be slidable along the extending direction of the crossbar, wherein the brake device is physically independent of, and not in part of, the driving device.

7. The workpiece transfer apparatus for a press machine according to claim 6, wherein the brake device comprises a friction element, and is configured to compress the friction element only to one side of the crossbar to hold the workpiece retaining device, without having another friction element to be compressed to another side of the crossbar.

* * * * *